United States Patent [19]

Musser

[11] 4,286,529

[45] Sep. 1, 1981

[54] COMBINATION HANGER AND EXPANSION PLATE FOR ELECTRIC FURNACE ROOF

[75] Inventor: John J. Musser, Kansas City, Mo.

[73] Assignee: Geo. P. Reintjes Co., Inc., Kansas City, Mo.

[21] Appl. No.: 29,932

[22] Filed: Apr. 13, 1979

[51] Int. Cl.[3] ..... F23B 7/00

[52] U.S. Cl. ..... 110/340; 110/336

[58] Field of Search ..... 110/339, 340, 336; 432/252

[56] References Cited

U.S. PATENT DOCUMENTS

| | | | |
|---|---|---|---|
| 2,991,736 | 7/1961 | Kivala et al. | 110/340 |
| 3,086,327 | 4/1963 | Samuel et al. | 110/336 X |
| 3,139,048 | 6/1964 | Hall | 110/340 X |

*Primary Examiner*—Edward G. Favors

*Attorney, Agent, or Firm*—Schmidt, Johnson, Hovey & Williams

[57] ABSTRACT

Hanger and expansion plate structure for use with refractory brick employed in electric furnace roofs is disclosed which is designed for accommodating the variable, heat-induced expansion of such furnace bricks. The structure includes respective metallic plates having transverse, brick-engaging ribs with channels therebetween; the width of the ribs is greatest adjacent the hot face of the bricks so that the plates collapse or yield at the hot face under lateral brick expansion while remaining substantially intact adjacent the cold brick face. Thus, the variable expansion of the brick is accommodated without sacrifice of the overall integrity of the roof construction. Certain of the plates have oblique flanges which are received within complemental recesses in the bricks for supporting the latter.

2 Claims, 3 Drawing Figures

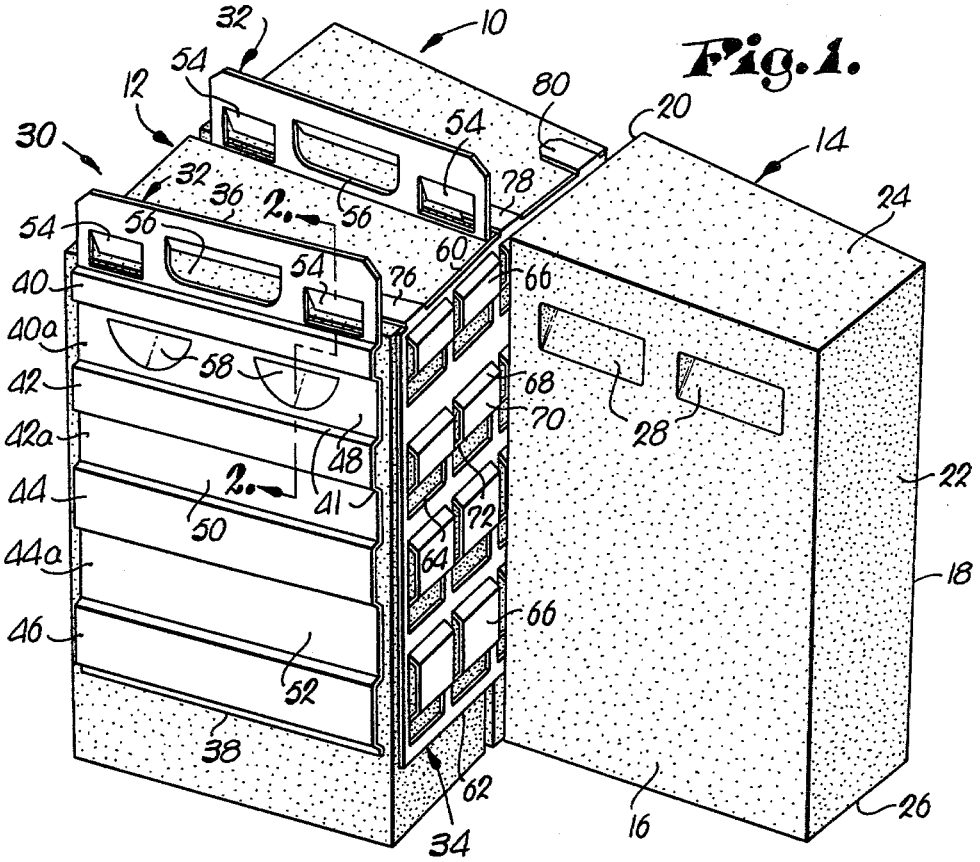
Fig. 1.
Fig. 3.
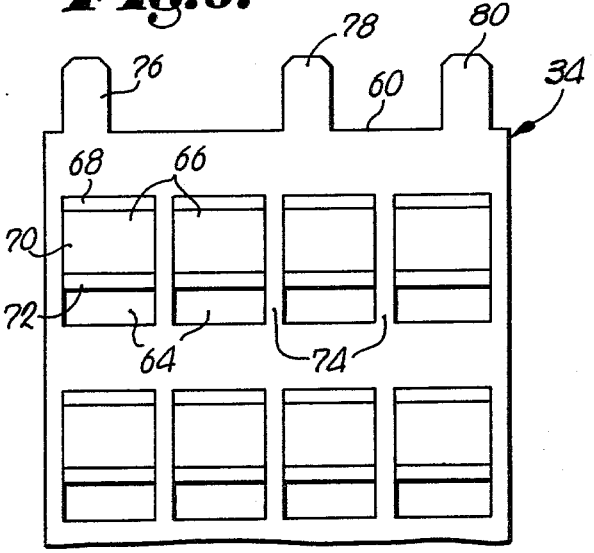
Fig. 2.
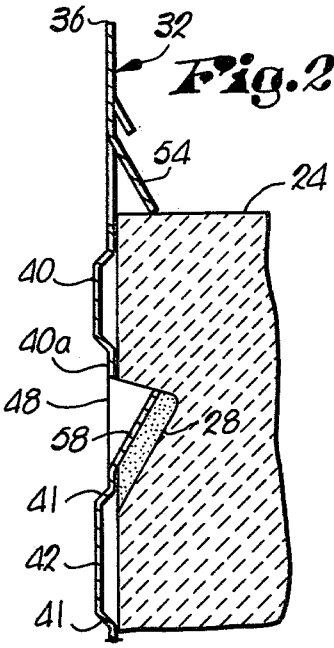

COMBINATION HANGER AND EXPANSION PLATE FOR ELECTRIC FURNACE ROOF

BACKGROUND OF THE INVENTION

1. Field of the Invention

The present invention is concerned with combination hanger and expansion plate structure for use in supporting and spacing refractory bricks in furnace constructions. More particularly, it is concerned with specialized plates of this type which include brick-engaging projection surfaces configured such that the projection surfaces adjacent the hot faces of the bricks will yield when subjected to high temperature conditions and consequent lateral expansion of the furnace bricks, while the projection surfaces adjacent the opposite or cold faces of the bricks will remain substantially intact.

2. Description of the Prior Art

Metal encased refractory bricks have long been employed to construct electric furnace roofs. Generally speaking, these encased bricks are arranged in a predetermined pattern and are suspended by means of conventional hangers or the like. For the most part, bricks of this type are constructed as a unit, i.e., the refractory brick is encased within a surrounding metallic sleeve at the factory.

It has also long been recognized that refractory bricks, when subjected to high furnace temperatures, expand in a variable fashion. That is to say, the lateral expansion of the bricks is greatest adjacent the so-called "hot faces" thereof, or the faces which define the internal surface of the roof. On the other hand, the heat-induced expansion adjacent the cold or exterior faces of the bricks is much less. As can be appreciated, a unitary, permanently attached casing or sleeve around a refractory brick cannot really accommodate variable expansion. In fact, it is known that refractory brick life is considerably lessened because of this shortcoming with conventional encased bricks.

Prior refractory brick constructions of the type discussed above are illustrated in the following patents: U.S. Pat. Nos. 3,282,231, 3,174,444, 3,280,772, 2,125,192, 2,266,785, 2,281,200, 2,885,976, 2,960,048, 2,991,736, 3,083,453, 3,181,486, 3,416,780, 3,252,436, 3,073,067, 3,205,842, 3,213,533, 3,566,571, 3,287,872 and French Pat. No. 1,251,356.

SUMMARY OF THE INVENTION

The present invention is concerned with a spacing member adapted to be positioned between adjacent refractory bricks and which comprises an elongated sheet of metallic material with a series of brick-engaging ribs spaced along the length of the sheet. The ribs are preferably configured to define channels therebetween, and are sized such that at least certain of the ribs are of increasing width from the upper to the lower margin of the sheet. In this way the brick-engaging ribs adjacent the lower or hot face of the brick can yield or collapse under the influence of lateral brick expansion, whereas the more rigid upper ribs serve to maintain the bricks in their proper spaced relationship.

Certain of the spacing members are further provided with integral flanges which extend obliquely and are received within corresponding recesses in the bricks. Moreover, these sheets include an upper portion extending above the cold face of the bricks for supporting the latter in a roof construction.

In a furnace roof in accordance with the invention, adjacent, side-by-side refractory bricks are maintained in proper spaced relationship by means of first spacing members disposed therebetween, while second spacing members are disposed in spanning relationship to each pair of bricks and are in engagement with the proximal end faces of the latter. Each of the first and second spacing members includes the described brick-engaging ribs of varying width from top to bottom. In the case of the second members however, the ribs are secured only along one marginal edge thereof to the sheet in order to facilitate and enhance the yielding thereof under expansion forces. In addition, upright areas of weakness are defined in the second spacing members for permitting the latter to be deformed to accommodate a circular roof configuration.

BRIEF DESCRIPTION OF THE DRAWING

FIG. 1 is a perspective view illustrating three adjacent refractory bricks having the spacing members of the present invention interposed therebetween;

FIG. 2 is a sectional view taken along irregular line 2—2 of FIG. 1; and FIG. 3 is a fragmentary end view illustrating the construction of one of the spacing members illustrated in FIG. 1.

DESCRIPTION OF THE PREFERRED EMBODIMENT

Referring first to FIG. 1, a portion of a circular furnace roof construction is illustrated. Specifically, respective furnace bricks 10, 12, and 14 are illustrated, with bricks 10 and 12 being in juxtaposition, whereas brick 14 is placed end-to-end with respect to brick 10. As will be readily appreciated, the bricks 10, 12 are in one circular row of bricks, whereas brick 14 is in the adjacent circular row. Each such brick includes spaced, planar, opposed, diverging sidewalls 16 and 18, spaced, planar, opposed end walls 20 and 22, and planar, trapezoidal top and bottom walls 24 and 26. Inasmuch as the bricks 10, 12 and 14 are identical, like reference numerals will be used for the respective parts thereof.

As seen in FIG. 1, sidewall 16 is provided with a pair of inwardly extending recesses 28 which are elongated and somewhat triangular in cross section. Moreover, the top walls 24 of the bricks define the so-called "cold faces" thereof, whereas the opposed bottom walls 26 present the so-called "hot faces" of the brick.

Combination hanger and expansion plate structure broadly referred to by the numeral 30 is employed for supporting the bricks 10, 12 and 14. This structure 30 includes a first plate member 32 which is disposed between at least certain of the side-by-side bricks 10, 12 in a given circular row of furnace roof construction. Specifically, the member 32 is disposed between and engages the adjacent faces 16 and 18 of juxtaposed bricks. In addition, a second plate member 34 is employed which spans the adjacent end walls 22 of a pair of bricks 10, 12, and is in engagement with such walls. The second plate members 34 space and engage the adjacent circular rows of bricks making up the roof.

In more detail, the plate 32 is in the form of an elongated, metallic, unitary sheet having an upper margin 36 and a lower margin 38. The brick-engaging portion of the sheet 32 is provided with a series of elongated, transversely extending, rectangular ribs 40–46 which, as best illustrated in FIG. 1, are of increasing widths (i.e., measured vertically) going from the uppermost rib 40 to the lowermost rib 46. Adjacent ribs are interconnected by rectangular metallic sheet elements 40*a*, 42*a* and 44*a* which, with the laterally extending connecting sidewalls 41 of the ribs, define channels 48–52. Thus, both the upper and lower margins of the ribs 40–46 are integral with the overall sheet. Furthermore, the faces of the stretches 40*a*, 42*a* and 44*a* remote from the ribs 40–46 engage one brick face, whereas the ribs themselves engage the proximal face of the adjacent brick, to thus present a series of similar, but horizontally offset brick-engaging surfaces on both faces of the member 32.

The uppermost portion of the plate 32 is essentially planar and includes a pair of spaced, downwardly extending, obliquely oriented flanges 54, as well as an upper flange 55 which is adjacent the hanger-receiving opening 56. The flange 55 makes contact with the hanger unit and, if the loading is great enough, the flange 55 is bent backwardly toward the sheet 32 to increase the strength of the assembly. The flanges 54 engage the top wall 24 of a respective brick, and serve to hold the plate in place against the sidewall of the respective brick during roof assembly so that an additional brick can be placed against the opposite face of the plate.

A pair of inwardly and upwardly extending, obliquely oriented, stretched flanges 58 of semicircular configuration are connected to the metallic sheet element 40*a*. These flanges are received within the recesses (see FIG. 2) in order to support the refractory bricks, as will be described.

Second plate member 34 is in the form of an elongated, metallic, unitary sheet having an upper margin 60 and a lower margin 62. A series of vertically and horizontally aligned, rectangular cutout openings 64 are formed in the body of member 34, and a respective, outwardly projecting rib element 66 is secured to the uppermost margin of each respective opening 64. In particular, the rib elements 66 each include an obliquely oriented top wall 68, an elongated, rectangular, transversely oriented, brick-engaging wall 70, and an inwardly extending bottom wall 72 which is identical with the wall 68 but is oppositely oriented as best seen in FIG. 1.

It will also be noted that the rib elements in each horizontally extending row are configured such that the respective rib walls 70 thereof increase in width from the uppermost row to the lowermost row. Moreover, respective, transversely extending channels are defined between the separate rows of rib elements. Finally, elongated, continuous vertically extending areas of weakness 74 are provided between vertically aligned columns of increasing-width rib elements.

Three support tabs 76, 78 and 80 are integral with and extend from the upper margin 60 of plate member 34. As best viewed in FIG. 1, the support tabs are employed to position the member 34 in spanning relationship to the bricks 10, 12. In this connection, it will be seen that the tabs are spaced such that tab 76 is in engagement with the cold face of brick 12, whereas tabs 78 and 80 engage the cold face of brick 10.

In the use of hanger and expansion plate structure 30, a solid concrete form having the contour of the hot face of the roof is employed. The bricks are placed atop the form one at a time, with the expansion plates 32 being placed between side-by-side bricks, and the plates 34 between separate rows of bricks. The preconstructed roof is then shifted through conventional hanger structure (not shown) to the electric furnace itself, and positioned thereon. During the described initial positioning of the plates 32, the flanges 58 of each plate member 32 are inserted within the recesses 28 of the corresponding bricks, so that these plates can support the bricks in the final roof. Moreover, the second spacing members 34 are installed by simply bending the tabs 76–80 as illustrated in FIG. 1, and placing the members 34 in spanning relationship to juxtaposed pairs of bricks in a given row.

In the latter connection, it is significant that the vertical areas of weakness 74 are provided in the members 34. That is to say, these members can be bent along the areas of weakness 74 to approximate the needed curvature for a given circular row of bricks.

In operation, the members 32, 34 are designed to accommodate the variable expansion characteristic of refractory bricks. Specifically, the lowermost ribs provided in the member are of greater width (measured vertically) than the ribs thereabove. Accordingly, these ribs can yield or collapse under the influence of the high temperature conditions within the furnace and consequent lateral expansion of the refractory brick. This yielding or collapse occurs without loss on integrity of the overall roof structure, inasmuch as the more rigid upper ribs provided with the member maintain the proper spacing between bricks and are less likely to yield or collapse.

Having thus described the invention, what is claimed as new and desired to be secured by Letters Patent is:

1. A spacing member for positioning between adjacent refractory bricks, said member comprising an elongated sheet of metallic material having an upper margin and a lower margin and configured to present, on at least one face thereof, a plurality of spaced brick-engaging surfaces along the length of the sheet between said margins, said surfaces comprising elongated, flattened ribs presenting upper and lower rib margins, with channels between adjacent ribs, said ribs being of generally rectangular configuration, only one of said upper and lower ribs margins being connected to said sheet, the connected rib margin being the only connection between the ribs and the sheet.

2. A spacing member for positioning between adjacent refractory bricks, said member comprising an elongated sheet of metallic material having an upper margin and a lower margin and configured to present, on at least one face thereof, at least one series of brick-engaging surfaces spaced along the length of the sheet between said margins, said surfaces comprising ribs presenting spaced rib margins, with channels between adjacent ribs, only one of said rib margins being connected to said sheet, said connected rib margins being the only connection between the ribs and sheet.

* * * * *